US005956991A

United States Patent [19]

Tseng

[11] Patent Number: 5,956,991

[45] Date of Patent: Sep. 28, 1999

[54] FORMING DEVICE FOR SHAPED DECORATION PANELS

[76] Inventor: Shao-Chien Tseng, No. 130 Sec. 2. Yang-Shin Rd., Yang- Mei Taoyuan 326, Taiwan

[21] Appl. No.: 09/136,702

[22] Filed: Aug. 19, 1998

[51] Int. Cl.[6] ..... B21D 5/08

[52] U.S. Cl. ..... 72/213; 72/389.1; 72/389.2

[58] Field of Search ..... 72/212, 213, 389.1, 72/389.3, 389.2

[56] References Cited

U.S. PATENT DOCUMENTS 3,986,379 10/1976 Mansell ..... 72/57
5,016,350 5/1991 Burenga ..... 72/213
5,237,847 8/1993 Owens ..... 72/213
5,542,282 8/1996 Muldner ..... 72/389.1

*Primary Examiner*—David Jones
*Attorney, Agent, or Firm*—Pro-Techtor International Services

[57] ABSTRACT

A forming device to shape decoration panels having relieved contours features a design that includes an upper and a lower laminated spring, a flexible die within a frame formed by a spiral strip spring, and a plurality of movable rollers. The purpose of the device is to use the spring frame to hold the flexible die which is used to prevent die blocking. The upper and lower laminated springs can be used to spread the action force in forming, and to support the flexible die. Thus concentration of stress in a decoration panel during forming can be avoided.

3 Claims, 5 Drawing Sheets

FORMING DEVICE FOR SHAPED DECORATION PANELS

BACKGROUND OF THE INVENTION

1. Field of the Invention

The present invention is related to a forming device for shaped decoration panels, and especially for shaped decoration panels made of non-ferrous alloy that are of high quality and have relieved fine decoration. The device is used to bend the shaped decoration panels.

2. Description of the Prior Art

Conventional high quality shaped decoration panels are made of gold, silver; copper, aluminum, titanium etc. Shaped decoration panels made of these materials satisfy the requirement of strength for durability and high quality, and are made generally by casting techniques. The techniques in the prior art do not consider the fact that the density of a cast article is not uniform for the entire surface. The surface is therefore difficult to grind and the resulting panel is not as strong as panels formed by other processes.

Shaped decoration panels made by a cold forming technique have the required strength and fineness of their surfaces. A cold forming technique producing a shaped decoration panel from a blank normally uses an alloy steel die. The die is formed having a die cavity with a desired shape, and the die can bear the pressure exerted by a forging press to forge the blank into the shaped decoration panel. The wall of the shaped decoration panel normally is formed to have relieved embossments (to be called decoration embossments hereinafter). The decoration embossments must be carved on the wall of the die cavity of the steel die in order to form a shape on the decoration panel; however, such a technique can only be used when forming a planar decoration panel. If the shaped decoration panel with relieved embossments is to be formed into an arciform decoration panel, this technique will not work.

To meet the strength requirement, the decorative portions on the shaped decoration panel should not be partially pressed before bending by a forming press. This may cause the shaped decoration panel to be weakened from stress. Bending a planar decoration panel in an arciform steel die cavity, as is the case in a conventional technique, tends to bend the decoration panel with non-uniform, concentrated stress. Due to stiffness of the die cavity, the relieves on the decoration panel which is arciform due to bending in the die cavity, tend to hold the die in the die cavity. This phenomenon causes scratching damage on the decoration embossments of the decoration panel when the panel is removed from the die cavity, and the product will therefore be inferior.

Due to this problem, manufacturers in the art mostly make the side walls of the decoration embossments of the decoration panel tapered in order to avoid die blocking, or difficulty in removing the panel from the die. However, tapering the walls reduces the delicacy as well as the scope of variation of modeling of the decoration embossments, which are desired to be artistic. Thus this solution is impractical.

SUMMARY OF THE INVENTION

The shaped decoration panel of in the present invention is directed to a common decoration panel having relieved contours that is shaped by forming. However, the bending device of the present invention is used to take the place of the conventional steel dies and their die cavities, in order that it can be used in bending shaped decoration panels into arciform decoration panels.

The present invention features a design that includes an upper and a lower laminated spring, a flexible die within a frame formed by a spiral strip spring, and a plurality of movable rollers. The purpose of the present invention is to use the spring frame to hold the flexible die which is used to prevent die blocking. The upper and lower laminated springs can be used to spread the action force in forming, and to support the flexible die. Thus concentration of stress in a decoration panel during forming can be avoided.

These and other objects and advantages of the present invention will become apparent to those skilled in the art in view of the description of the best presently known mode of carrying out the invention as described herein and as illustrated in the drawings.

DETAILED DESCRIPTION OF THE PREFERRED EMBODIMENT

Figure 1:
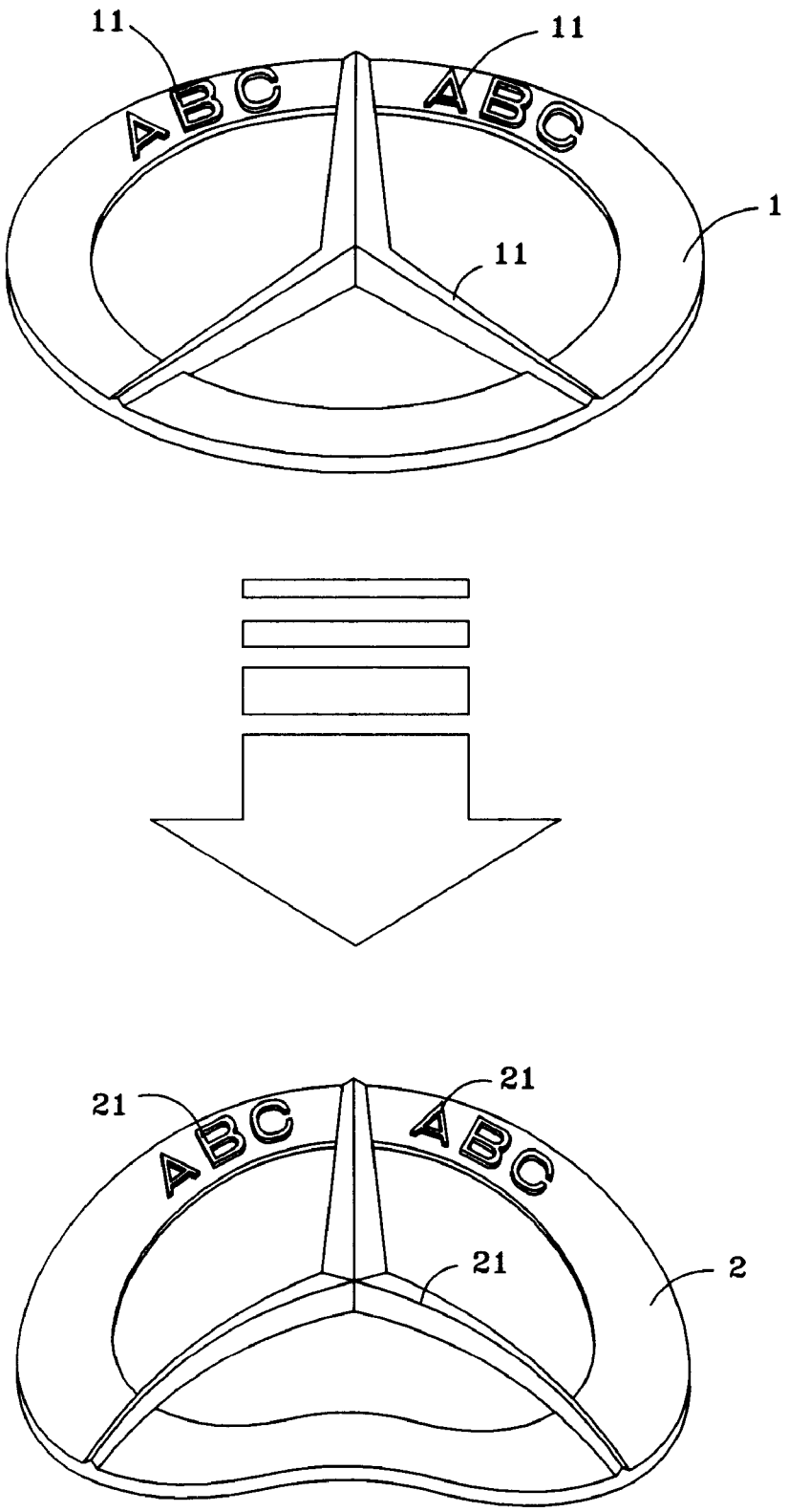
FIG. 1 is a perspective view showing a shaped decoration panel of the present invention which is formed into an arciform decoration panel.

Referring to FIG. 1, the shaped decoration panel 1 of the present invention is directed to a decoration panel formed and shaped to have decoration embossments 11 with relieved contours. The bending and forming device of the present invention can be used to effectively form the shaped decoration panel 1. The device can turn a planar decoration panel 1 with decoration embossments 11 into an arciform decoration panel 2. By virtue of that the bending forming device having the effect of diffusing forming pressure and preventing die blocking, a plurality of arciform decoration embossments 21 can be formed and shaped on the decoration panel 2 with uniform bending pressure. The arciform decoration embossments 21 can thus appear with high quality and durable forging strength, as well as with intricate designs. Further, the shaped decoration panel 1, 2 can be easily removed from the die.

Figure 2:
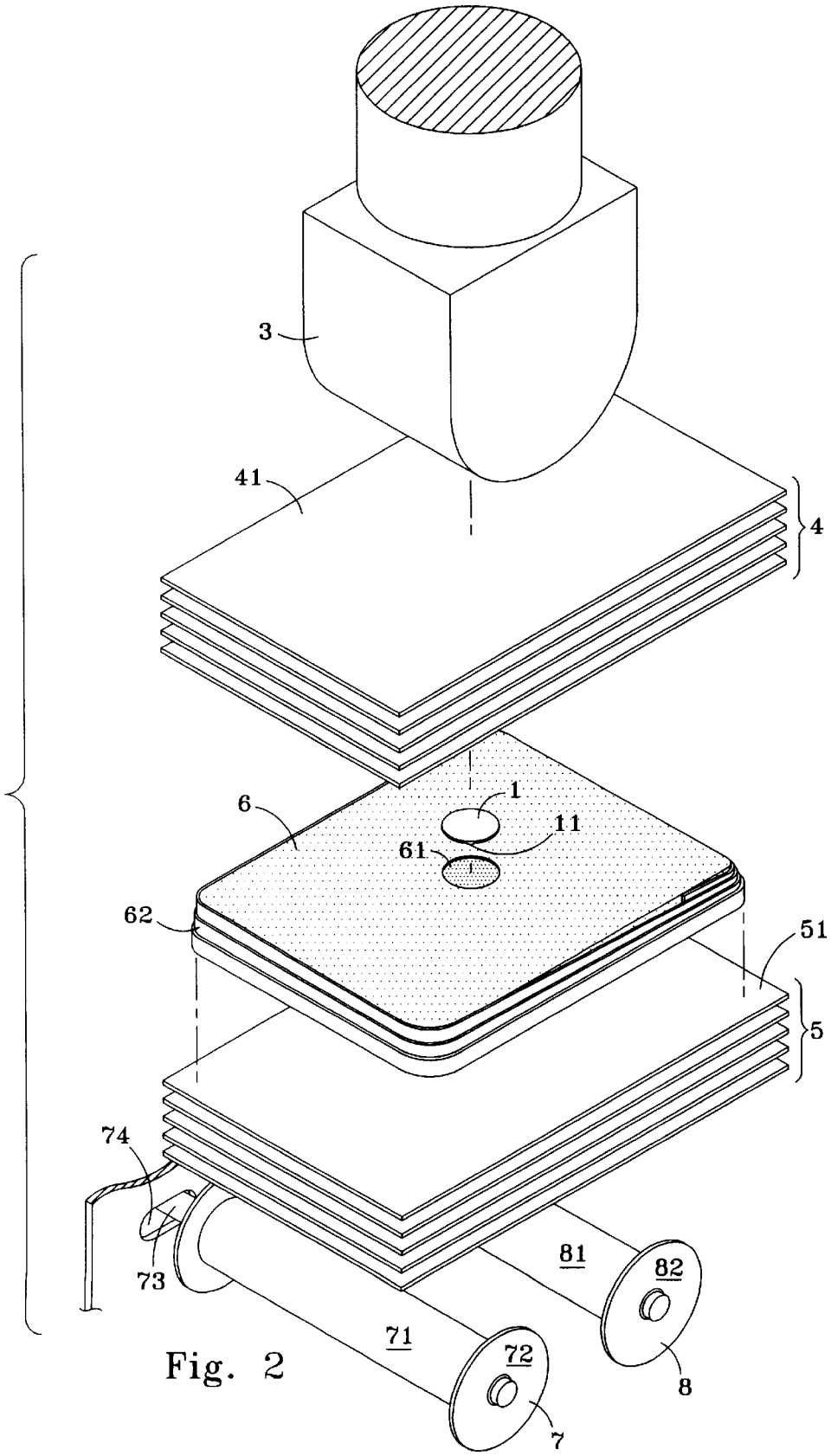
FIG. 2 is a perspective view of the forming device of the present invention.

The forming device (as shown in FIG. 2) includes an upper laminated spring set 4 and a lower laminated spring set 5 positioned beneath a forming press 3. A frame 62 formed by a spiral strip spring is provided between the upper laminated spring set 4 and the lower laminated spring set 5. A flexible die 6 is enclosed in the spring frame 62. The top surface of the flexible die 6 includes in the center thereof a depression 61. The bottom of the lower laminated spring set 5 straddles two movable rollers 7 8. Thereby the forming device for forging shaped decoration panels 1 is completed.

Figure 3:
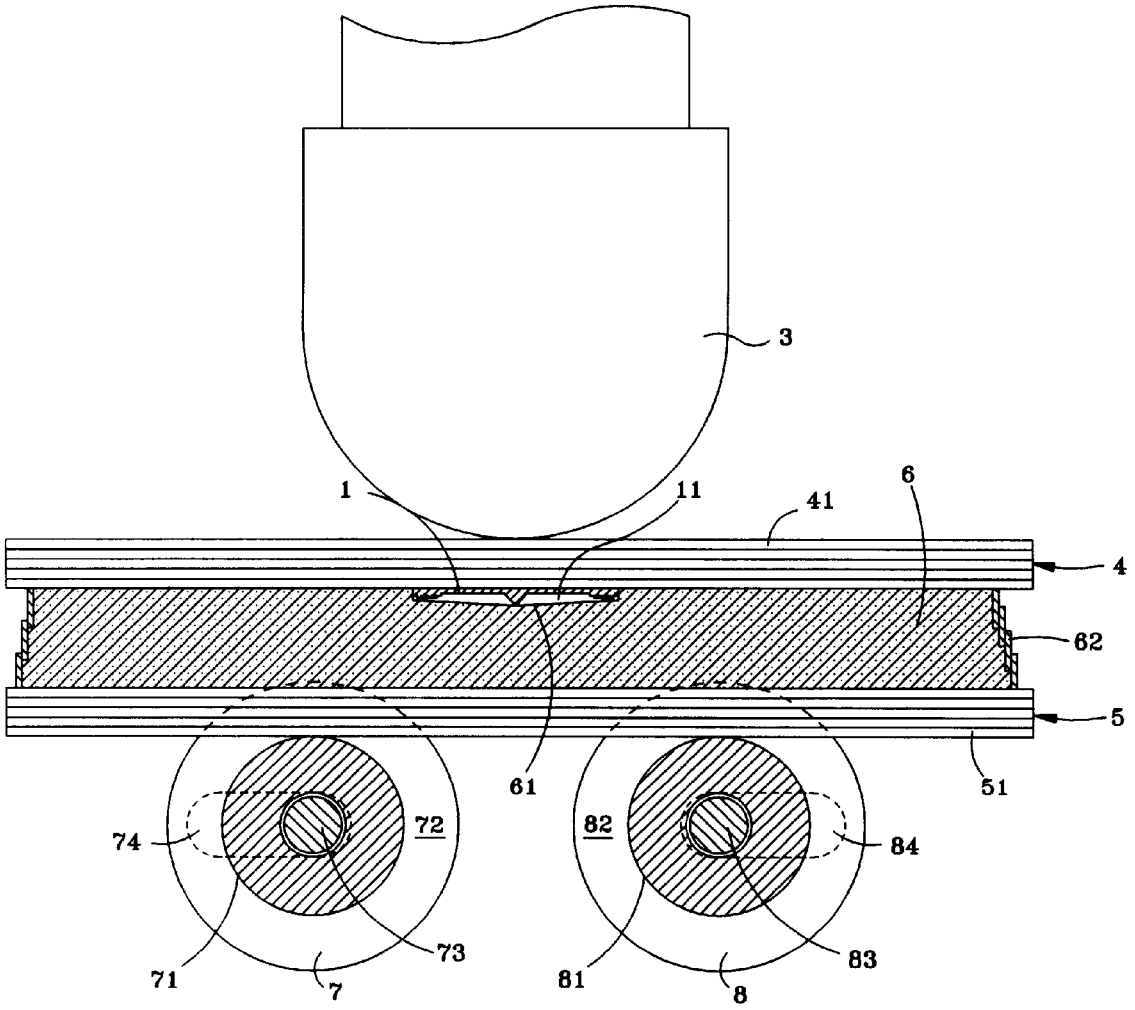
FIG. 3 is a sectional view showing the assembly of the forming device of the present invention.

The upper laminated spring set 4 and the lower laminated spring set 5 are formed respectively from a plurality of laminated springs 41 and 51. The top surface of the flexible die 6 is covered by the bottom laminated spring 41 of the upper laminated spring set 4. The shaped decoration panel 1, which is received in depression 61, is also covered by the bottom laminated spring 41 of the upper laminated spring set 4. The bottom of the flexible die 6 rests on the top surface of the uppermost laminated spring 51 of the lower laminated spring set 5 (referring to FIG. 3).

The spring frame 62 is formed by circling a spiral strip spring that is filled with a two-agent type PU (i.e., agent A+agent B) to form the flexible die 6. The flexible die 6 includes in the center thereof the depression 61. Thereby, the flexible die 6 and the depression 61 are provided with excellent plastic deforming capability. When they are acted upon by bending and forming forces, they can protect the decoration embossments 11 on the shaped decoration panel 1 to keep the comer angles and edges intact. The arciform decoration panel 2 is formed after bending and forming. The arciform decoration embossments 21 thereon can be released easily from the depression 61. It is easy to remove the shaped decoration panel 1 from the die after bending and forming.

The surface of the working end of the forming press 3 is arciform. In fact, the radius of the arc of the arciform decoration panel 2 to be formed equals the radius of the forming press 3 with the thickness of the upper laminated spring set 4 added thereto.

The two movable rollers 7, 8 are each provided with a roller surface 71, 81 and with two end walls 72, 82 respectively. The lower laminated spring set 5 is placed on the roller surfaces 71, 81 of the two movable rollers 7, 8. The spring set 5 is held by the end walls 72, 82 of the rollers 7, 8. The rollers 7, 8 are respectively provided with two axles 73, 83, each of which has one of its ends extended through a hole 74, 84 (referring to FIGS. 2 and 3) for moving therein.

Figure 4:
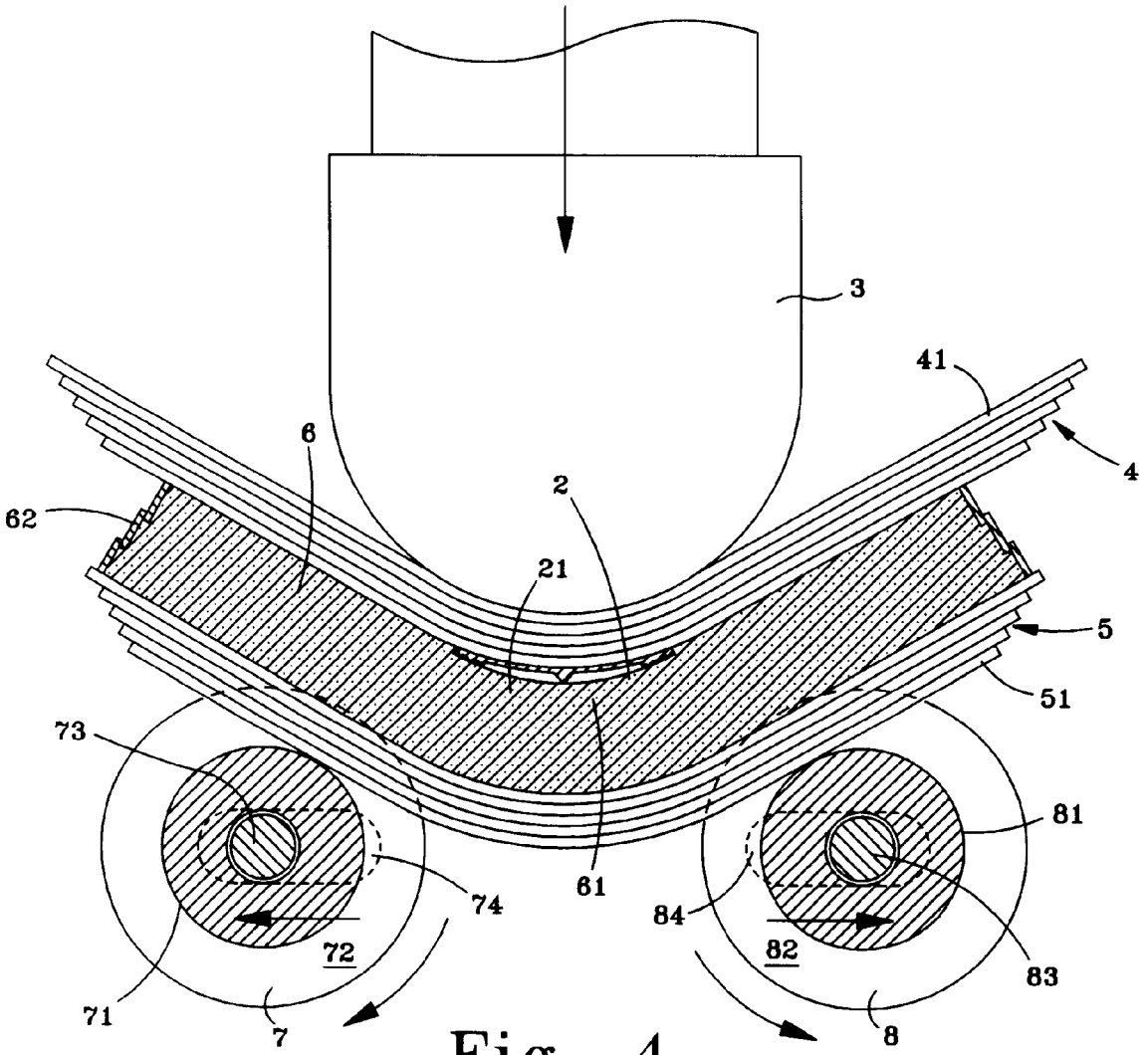
FIG. 4 is a sectional view showing the bending process of the present invention.

When the shaped decoration panel 1 is placed in the depression 61 and the forming press 3 presses down on the upper laminated spring set 4 (referring now to FIG. 4), the normal action force of the forming pressure exerting downwardly is effectively spread. The force is spread through the laminated springs 41 of the upper laminated spring set 4 to form radiating components of the action force. The radiating components of the action force are transmitted to the spring frame 62 and the flexible die 6 so that the portions to be formed on the shaped decoration panel 1 in the depression 61 can equally scatter the action force to bend and to form the arciform decoration panel 2 and the contours of the arciform decoration embossments 21. The components of the action force are also transmitted to the lower laminated spring set 5. By absorption and reflection of the components of the action force by the laminated springs 51, the portions of the decoration panel being bending formed in the depression 61 can scatter the bending pressure uniformly. Thereby, damage created by stress can be prevented. When the lower laminated spring set 5 transmits the components of the bending action force to the two movable rollers 7, 8, the rollers move outward in the holes 74, 84 as the two axles 73, 83 move, thereby further dissipating the force.

Figure 5:
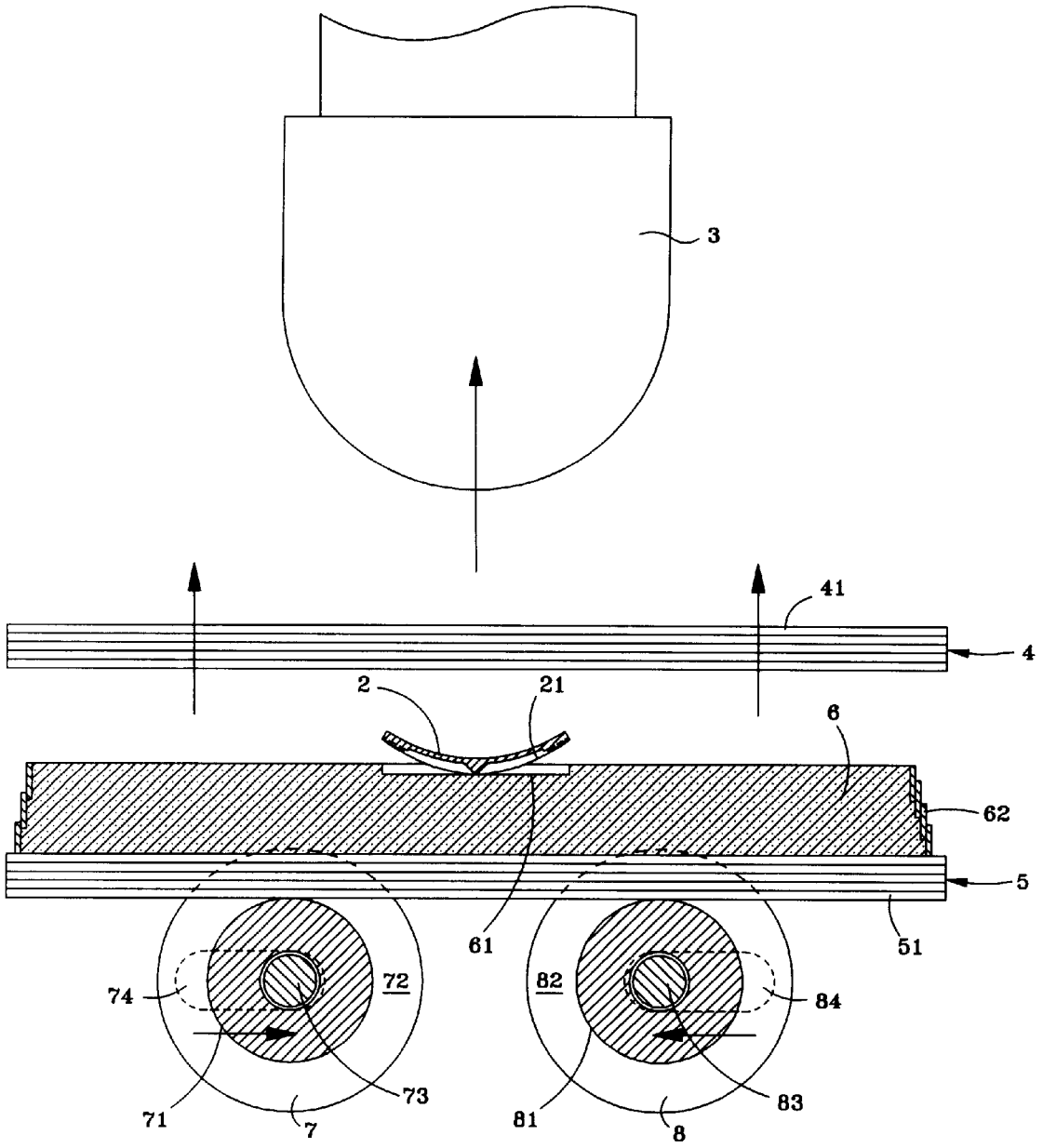
FIG. 5 is a sectional view of the panel after bending.

When the single-stroke pressing operation is completed (referring to FIG. 5), the forming press 3 and the upper laminated spring set 4 are removed upwardly. Then the two movable rollers 7, 8, the flexible die 6, and the lower laminated spring set 5 are released from the forming pressure and restored to their original state. With the arciform decoration panel 2 and the decoration embossments 21 thereon being bent to the desired curvature, the embossment 11 can automatically move out of the depression 61 which has now been restored its original state. This is helpful for removing the product from the die.

Before forming with the present invention, a suitable plurality of laminated springs are required to be mounted on the top and bottom of the spring frame 62 and the flexible die 6. In this way the upper laminated spring set 4 and the lower laminated spring set 5 are formed to be able to sufficiently absorb and scatter the forming action force. The number of layers of and the height of the spiral strip spring forming the spring frame 62, as well as the volume and thickness of the flexible die 6 containing the two-agent type PU (i.e., agent A+agent B), is changed according to the strength of the material of the shaped decoration panel 1 to be formed and the pressure to be applied.

The above disclosure is not intended as limiting. Those skilled in the art will readily observe that numerous modifications and alterations of the device may be made while retaining the teachings of the invention. Accordingly, the above disclosure should be construed as limited only by the restrictions of the appended claims.

I claim:

1. A forming device adapted to shape decoration panels comprising:

a forming press, an upper laminated spring set, a lower laminated spring set, a frame, a flexible die, and two movable rollers; wherein a lower surface of said forming press is arciform, said upper laminated spring set and said lower laminated spring set are formed from a plurality of laminated springs, said frame is formed by a strip spring enclosing an area by being spiraled around said area, said flexible die is placed in said spring frame, and a top surface of said flexible die includes at least one depression therein, said movable rollers are each provided with two end walls and a protruding axle, at least one end of each of said two axles is supported in a slot in a supporting frame so that said movable rollers move away from each other when pressure is applied by said forming press, and said movable rollers move toward each other when pressure is released from said forming press, said upper laminated spring set and said lower laminated spring set are positioned beneath said forming press with said frame situated between said upper laminated spring set and said lower laminated spring set, and said lower laminated spring set rests on surfaces of said movable rollers and is held on said surfaces by said end walls; such that during a forming operation, the decoration panel to be formed is positioned in said depression in said flexible die with an embossment in contact with said panel, pressure being applied by said forming press and dispersed by said upper and said lower laminated spring sets, said movable rollers being moved apart so as to further disperse the pressure, and the decoration panel is bent so as to form an arciform panel.

2. The forming device as claimed in claim 1 wherein:

a radius of curvature of said arciform decoration panel is equal to a radius of a lower side of said upper laminated spring set when said upper laminated spring set receives pressure from said forming press.

3. The forming device as claimed in claim 1 wherein:

said spring frame is formed by a strip spring wrapped in a spiral fashion, said spring frame is filled therein with a two-agent type PU to form said flexible die.

* * * * *